US010106878B2

(12) United States Patent
Li et al.

(10) Patent No.: US 10,106,878 B2
(45) Date of Patent: Oct. 23, 2018

(54) SURFACE TEXTURE PROVIDING IMPROVED THERMAL SPRAY ADHESION

(71) Applicant: GM Global Technology Operations LLC, Detroit, MI (US)

(72) Inventors: Zhe Li, Rochester, MI (US); Martin S. Kramer, Clarkston, MI (US); Yucong Wang, West Bloomfield, MI (US); Jianghuai Yang, Rochester Hills, MI (US)

(73) Assignee: GM GLOBAL TECHNOLOGIES OPERATIONS LLC, Detroit, MI (US)

( * ) Notice: Subject to any disclaimer, the term of this patent is extended or adjusted under 35 U.S.C. 154(b) by 212 days.

(21) Appl. No.: 15/184,699

(22) Filed: Jun. 16, 2016

(65) Prior Publication Data

US 2017/0362691 A1 Dec. 21, 2017

(51) Int. Cl.
*C23C 4/02* (2006.01)
*F02F 1/00* (2006.01)

(52) U.S. Cl.
CPC ..... *C23C 4/02* (2013.01); *F02F 1/004* (2013.01)

(58) Field of Classification Search
CPC ..... C23C 4/02; F02F 1/004
See application file for complete search history.

(56) References Cited

U.S. PATENT DOCUMENTS 7,059,290 B2 * 6/2006 Ishikawa ..... F02F 1/20 123/193.2
2016/0289856 A1 * 10/2016 Morawitz ..... C25D 11/026
2018/0045134 A1 * 2/2018 Yang ..... F02F 1/004

* cited by examiner

*Primary Examiner* — Kevin A Lathers

(57) ABSTRACT

An improved substrate surface texture i.e., roughness, significantly improves the adhesion of thermal spray coatings. The surface texture is defined by two metrology parameters and the invention comprehends a range of average roughness (Sa) between 9 and 15 μm and developed interfacial area ratio (Sdr) of greater than 100%. This surface texture is achieved by methods such as water jet erosion, mechanical roughening, laser texturing, chemical etching and plasma etching. The surface texture is especially beneficial for walls of cylinders of internal combustion engines, hydraulic cylinders and similar components to which a thermal spray coating is adhered and which are exposed to sliding or frictional wear.

14 Claims, 2 Drawing Sheets

SURFACE TEXTURE PROVIDING IMPROVED THERMAL SPRAY ADHESION

FIELD

The present disclosure relates to improving the adhesion of thermal spray coatings to substrates and more particularly to surface textures that provide improved adhesion of thermal spray coatings to substrates.

BACKGROUND

The statements in this section merely provide background information related to the present disclosure and may or may not constitute prior art.

Thermal spraying is a coating process which applies material heated and typically melted by combustion or an electrical plasma or arc to a substrate. The process is capable of rapidly applying a relatively thick coating over a large area relative to other coating processes such as electroplating, sputtering and physical and vapor deposition.

The ruggedness and durability of the thermal spray coating would seem to be almost exclusively a feature of the material of the coating and to a lesser extent the quality of application. However, it has been determined that, in fact, typically the most significant factor affecting the ruggedness and durability of a thermal spray coating is the strength of the bond between the thermal spray coating and the substrate. A poor bond may allow the thermal spray coating to slough off, sometimes in relatively large pieces, long before the thermal sprayed material has actually worn away whereas a strong bond renders the thermal spray coating an integral and inseparable component of the substrate.

Several approaches have been undertaken to improve the bond between the thermal spray coating and the substrate. Typically these involve adjusting the composition of the thermally sprayed material and adjusting process parameters such as substrate temperature, application energy (and thus application velocity and temperature) and ambient conditions. The present invention is directed to another approach to improving the adhesion of thermal spray coatings to a substrate.

SUMMARY

The present invention provides an improved substrate surface texture i.e., roughness, which significantly improves the adhesion of thermal spray coatings. The surface texture is defined by two metrology parameters and the invention comprehends certain ranges of average three dimensional roughness (Sa) and developed interfacial area ratio (Sdr). This surface texture is achieved by methods such as water jet erosion, mechanical roughening, laser texturing, chemical etching and plasma etching. The surface texture is especially beneficial for walls of cylinders of internal combustion engines, hydraulic cylinders and similar components to which a thermal spray coating such as steel or a ceramic is adhered and which are exposed to sliding or frictional wear.

Thus it is an aspect of the present invention to provide a substrate surface to improve adhesion of a thermal spray coating.

It is a further aspect of the present invention to provide a texture to a substrate surface to improve adhesion of a thermal spray coating.

It is a still further aspect of the present invention to provide a texture to a substrate surface defined by two metrology parameters to improve adhesion of a thermal spray coating.

It is a still further aspect of the present invention to provide a texture to a substrate surface defined by average roughness (Sa) and developed interfacial area ratio (Sdr) to improve adhesion of a thermal spray coating.

It is a still further aspect of the present invention to provide a texture to a substrate surface defined by certain ranges of average roughness (Sa) and developed interfacial area ratio (Sdr) to improve adhesion of a thermal spray coating.

It is a still further aspect of the present invention to provide a texture to a substrate surface defined by two metrology parameters by water jet, mechanical roughening, laser texturing, chemical etching and plasma etching to improve adhesion of a thermal spray coating.

It is a still further aspect of the present invention to provide a texture to a substrate surface defined by average roughness (Sa) and developed interfacial area ratio (Sdr) by water jet, mechanical roughening, laser texturing, chemical etching and plasma etching to improve adhesion of a thermal spray coating.

It is a still further aspect of the present invention to provide a texture to a substrate surface defined by two metrology parameters to improve adhesion of a thermal spray coating to walls of cylinders of internal combustion engines.

It is a still further aspect of the present invention to provide a texture to a substrate surface defined by average roughness (Sa) and developed interfacial area ratio (Sdr) to improve adhesion of a thermal spray coating to walls of cylinders of internal combustion engines and similar components.

It is a still further aspect of the present invention to provide a texture to a substrate surface defined by certain ranges of average roughness (Sa) and developed interfacial area ratio (Sdr) to improve adhesion of a thermal spray coating to walls of cylinders of internal combustion engines.

Further aspects, advantages and areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
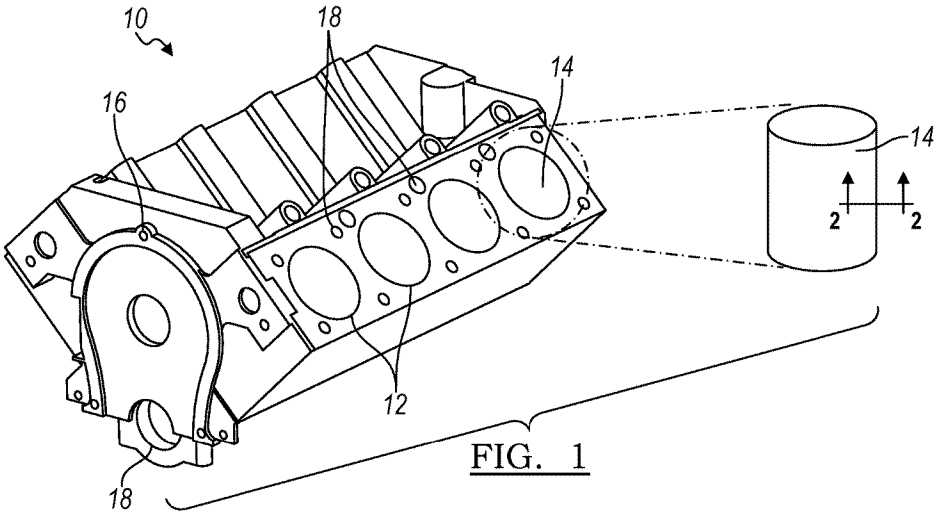
FIG. 1 is a diagrammatic view of an internal combustion engine block with an enlarged view of a cylinder wall.

With reference to FIG. 1, an internal combustion engine block is illustrated and generally designated by the reference number 10. The engine block 10 typically includes a plurality of cylinders 12 having interior cylinder walls 14, numerous flanges 16 and openings 18 for threaded fasteners and other features for receiving and securing components such as cylinder heads, shafts, manifolds and covers (all not illustrated). On the right side of FIG. 1 is an enlarged representation of the cylinder wall 14. The cylinder wall 14 may be a surface of a substrate such as an aluminum engine block 10 or a surface of an iron sleeve that has been installed in the engine block 10. In either case, the surface finish of the cylinder wall 14 may be a standard machine profile which is mechanically roughened or activated and preferably defines an average two dimensional surface roughness (Ra) of between about 4 to 25 μm (microns).

It will be appreciated that although illustrated in connection with the cylinder wall 14 of an internal combustion engine 10, with which it is especially beneficial, the present invention provides benefits and is equally and readily utilized with other cylindrical surfaces such as the walls of hydraulic cylinders and flat surfaces such as planar bearings which are exposed to sliding, frictional forces.

Figure 2B:
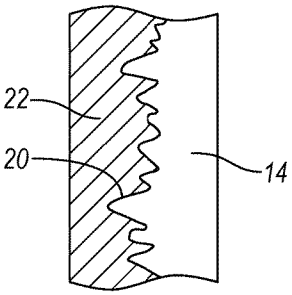
FIG. 2B is a view of the cylinder wall of FIG. 2A with a thermal spray coating applied thereto.
Figure 2A:
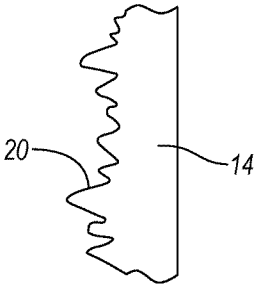
FIG. 2A is a greatly enlarged view of the cylinder wall taken along line 2-2 of FIG. 1, schematically showing the surface texture of the cylinder wall.

Referring now to FIG. 2A, a greatly enlarged cross section of the cylinder wall 14 schematically illustrates the substrate surface texture 20 of the treated or prepared surface of the cylinder wall 14. The substrate surface texture 20 may be prepared through a variety of methods including, but not limited to, water jet erosion, mechanical roughening, grit blasting, laser texturing, chemical etching and plasma etching.

Referring now to FIG. 2B, a greatly enlarged cross section of the cylinder wall 14 schematically illustrates the surface texture 20 of the cylinder wall 14 with a thermal spray coating 22 applied and adhered thereto. Typically, the thermal spray coating 22 for the cylinder wall 14 described herein, after honing, may be on the order of 150 μm and is typically within the range of from 130 μm to 175 μm. Other substrates and applications may, and typically will, require thermal spray coatings 22 having greater of lesser thicknesses. The thermal spray coating 22 may be a steel alloy, another metal or alloy, a ceramic, or any other thermal spray material suited for the service conditions of the product and may be applied by any one of the numerous thermal spray processes such as plasma, detonation, wire arc, flame or HVOF suited to the substrate and material applied.

Figure 3:
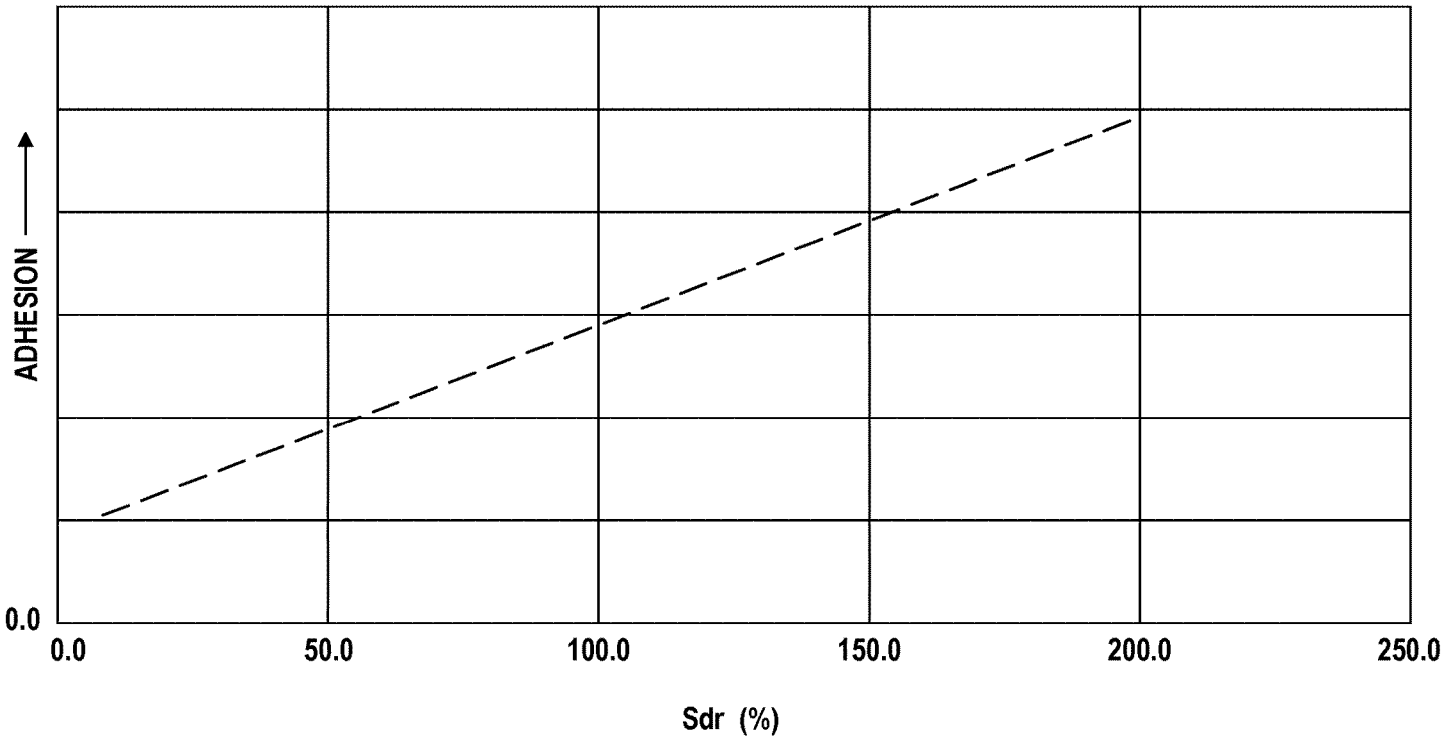
FIG. 3 is a qualitative graph which presents thermal spray coating adhesion on the vertical (Y) axis and percent Sdr texture on the horizontal (X) axis.

Referring now to FIG. 3, a qualitative graph illustrates the adhesion of the thermal spray layer as a function of Sdr, the percent of texture of the prepared substrate surface. Sdr, also referred to as the developed interfacial area ratio, in percent, is computed from the standard equation:

$$Sdr = \frac{\text{Suface Area of the Textured Surface} - \text{Cross Sectional Area}}{\text{Cross Sectional Area}}$$

For example, a unit of cross sectional area which has two units of area of textured surface has an Sdr percent of 100 (2−1/1). While FIG. 2 presents an essentially linear relationship between Sdr and adhesion strength, experimentation and life testing has determined that the adhesion achieved for Sdr's below 100% generally provides compromised ruggedness, durability and thus service life. Accordingly, though the limit is somewhat arbitrary, it should be understood that the most significant benefits of the present invention are achieved when the Sdr is at or above 100%.

The second numerical factor that defines the present invention is Sa, the average surface roughness evaluated over the complete three dimensional surface. The average surface roughness, Sa, is computed from the standard equation:

$$Sa=\iint_a |Z(x,y)|dxdy$$

where x, y and Z are measurements in the three orthogonal axes. The preferred range of Sa is between 9 and 15 μm whereas an operable, though less desirable range, is between 7 and 18 μm.

It should be understood that both of these measurements are three dimensional and that the surface texture achieved by the processes delineated below and represented by Sdr and Sa may be thought of or considered as a fractal, that is, a surface having a never ending pattern that is self-similar at different scales. Such surface texture is believed to enhance adhesion of the thermal spray coating by providing connections between the textured surface of the substrate and the thermal spray coating at multiple dimensional sizes or scales from sub-microscopic to microscopic.

While undertaken in general accordance with conventional techniques, it is deemed worthwhile to briefly describe the analysis steps undertaken to properly measure the foregoing parameters. First, tilt and macro surface curvature (such as would exist with cylinder walls), if any, are removed so that the measurement taken is flatted to a plane for analysis. Next, the area of interest is defined by histogram mapping. In a third step, similar to the first step, any curvature of the surface, is further removed for the selected area. Then a missing point is restored and a 0.25 mm three dimensional Gaussian filter is applied. With these preliminary steps and under these conditions, the foregoing roughness parameters can accurately be obtained.

The description of the invention is merely exemplary in nature and variations that do not depart from the gist of the invention are intended to be within the scope of the invention. Such variations are not to be regarded as a departure from the spirit and scope of the invention.

What is claimed is:

1. A friction surface for a cylinder bore comprising, in combination, a metal substrate having a mechanically activated surface, said activated surface treated to exhibit a range of average three dimensional roughness between 9 and 15 μm and a developed interfacial area ratio of greater than 100% to achieve a treated surface, and a thermal spray coating adhered to said treated surface.

2. The friction surface for a cylinder bore of claim 1 wherein said metal substrate is aluminum.

3. The friction surface for a cylinder bore of claim 1 wherein said thermal spray coating is one of steel and a steel alloy.

4. The friction surface for a cylinder bore of claim 1 wherein said treated surface is achieved by one of water jet erosion, mechanical roughening, grit blasting, laser texturing, chemical etching and plasma etching.

5. The friction surface for a cylinder bore of claim 1 wherein said activated surface of said metal substrate defines an avearge surface roughness (Ra) of between about 4 to 25 μm.

6. The friction surface for a cylinder bore of claim 1 wherein said metal substrate is iron.

7. A friction surface for a substrate comprising, in combination, a metal substrate having a mechanically activated surface, said activated surface treated to have a range of average three dimensional roughness between 9 and 15 μm and a developed interfacial area ratio of greater than 100% to provide a treated surface, and a thermal spray coating adhered to said treated surface.

8. The friction surface of claim 7 wherein said metal substrate is one of aluminum and iron.

9. The friction surface of claim 7 wherein said treated surface is created by exposing said activated surface to water jet erosion, mechanical roughening, grit blasting, laser texturing, chemical etching and plasma etching.

10. The friction surface of claim 7 wherein said meal substrate is a cylinder wall of an internal combustion engine.

11. The friction surface of claim 7 wherein said mechanically activated surface has an average roughness (Ra) of from 4 to 25 μm.

12. The friction surface of claim 7 wherein said thermal spray coating is one of steel, an alloy and a ceramic.

13. The friction surface of claim 7 wherein said thermal spray coating is applied by one of plasma, detonation, wire arc, flame and HVOF.

14. A friction surface for an aluminum cylinder bore comprising, in combination, an aluminum wall having a mechanically activated surface exhibiting an average surface roughness of from 4 to 25 μm, said activated surface treated to exhibit a range of average three dimensional roughness between 9 and 15 μm and a developed interfacial area ratio of greater than 100% to achieve a treated surface, and a thermal spray coating adhered to said treated surface.

* * * * *